US008607828B2

(12) United States Patent
Stutzman et al.

(10) Patent No.: US 8,607,828 B2
(45) Date of Patent: Dec. 17, 2013

(54) APPARATUS AND METHOD FOR FILLING CONTAINERS

(75) Inventors: Todd Stutzman, Overland Park, KS (US); Robert Muier, Lee's Summit, MO (US)

(73) Assignee: Catalent CTS (Kansas City), LLC, Wilmington, DE (US)

( * ) Notice: Subject to any disclaimer, the term of this patent is extended or adjusted under 35 U.S.C. 154(b) by 887 days.

(21) Appl. No.: 12/233,920

(22) Filed: Sep. 19, 2008

(65) Prior Publication Data

US 2009/0078335 A1 Mar. 26, 2009

Related U.S. Application Data

(60) Provisional application No. 60/974,075, filed on Sep. 20, 2007.

(51) Int. Cl.
*B65B 1/04* (2006.01)

(52) U.S. Cl.
USPC ..... 141/1; 141/144; 141/145; 141/146; 141/258; 53/253

(58) Field of Classification Search
USPC ..... 141/129, 71, 145, 144, 146, 258, 1; 53/253
See application file for complete search history.

(56) References Cited

U.S. PATENT DOCUMENTS

| | | | | |
|---|---|---|---|---|
| 3,656,517 | A * | 4/1972 | Taylor et al. | 141/1 |
| 4,469,144 | A * | 9/1984 | Burns | 141/1 |
| 4,961,446 | A * | 10/1990 | Berg et al. | 141/144 |
| 5,762,116 | A * | 6/1998 | Moore | 141/145 |
| 5,855,233 | A * | 1/1999 | Bolelli | 141/144 |
| 6,421,982 | B1 * | 7/2002 | Eichenberger | 53/253 |
| 6,425,422 | B1 * | 7/2002 | Trebbi | 141/67 |
| 6,810,930 | B2 * | 11/2004 | Schlipf et al. | 141/258 |
| 2001/0035431 | A1 * | 11/2001 | Runft | 141/146 |
| 2009/0014086 | A1 * | 1/2009 | MacMichael et al. | 141/12 |

* cited by examiner

*Primary Examiner* — Steven J Ganey
(74) *Attorney, Agent, or Firm* — Fitzpatrick, Cella, Harper & Scinto

(57) ABSTRACT

Disclosed is an apparatus useful for filling containers by means of a rotating turret which is configured to rotate the containers through the container-filing apparatus to a dosing portion where they are then are filled with material by way of a tamping mechanism. The container-filling apparatus may also include a container-conveying means to move the containers to the rotating turret. Methods of filling containers by using container-filling apparatuses according to embodiments of the invention are also disclosed.

20 Claims, 4 Drawing Sheets

APPARATUS AND METHOD FOR FILLING CONTAINERS

DESCRIPTION

This application claims priority to U.S. Provisional Patent Application No. 60/974,075, filed Sep. 20, 2007.

TECHNICAL FIELD

The invention described herein relates to an apparatus and a method for automatically delivering material, for example powder, into containers.

BACKGROUND

In the pharmaceutical industry, material such as powder is often transported in containers for a variety of reasons, including for example to patients in clinical trials or to formulators for development. Accurate and rapid filling of powders into containers would, therefore, provide improvements such as in clinical trial management and formulation development, by increasing efficiency and reducing costs.

Under current practice, both manual and automated methods exist for delivering material, for example powder, into containers, although such methods suffer from drawbacks. For example, the accuracy of the method can be influenced by such factors as the nature of the material, including the flow and density of powder, environmental conditions under which the operation takes place (e.g. humidity and temperature), and other factors.

In addition, manual methods can be laborious, time consuming, potentially inaccurate due to human error, etc., and therefore are useful only for very low-throughput applications. In such methods, for example, individual doses of powder may be weighed out by an individual using a balance and then transferred into a container. Alternatively, the powder may not be weighed directly but rather may be transferred into a container situated on a balance, at which time the weighing step occurs. These methods are neither time- nor cost-effective, particularly when a higher-throughput operation is needed.

Low-throughput automated methods for filling containers with powders, which may avoid some of the problems associated with manual methods described above, typically employ one of two mechanisms: those with gravity feed mechanisms like the Symyx Autodose POWDERNIUM®, or those with auger mechanisms like the Bohdan FLEXI-WEIGH®. Although such systems are generally accurate and flexible for both powder amount and type, they are still relatively slow, often requiring two to five minutes of delivery time per dose. Thus, those methods are practical primarily for low-throughput applications, such as laboratory work or formulation work including, for example, when 10-30 containers filled per hour is sufficient.

There are high-speed automated machines for high-throughput delivery of powders into, for example, capsules and other containers. One such method can fill many thousands of capsules or containers per hour and employs a dosator-type method. The dosator-type method involves plunging a cylinder of specific volume into a powder supply, or use of a vacuum to pick up powder in a cylinder of specific volume. The powder is then densified to form a cohesive plug. The powder plug is then ejected or released into a container or capsule. A disadvantage associated with this method may include, for example, the limitatibon on the type of powders which can be used, such as, for example, those which have the ability to form plugs by this method. Another disadvantage of the dosator-type method may include the potential loss of a large amount of powder due to either the necessary height of the powder supply, which must be higher than the height of the cylinder, or the loss of powder in vacuum systems where static charges may lead to inconsistent weight fills.

As another example of an automated high-throughput powder dispensing method, a method currently used for filling capsules uses a tamping-type mechanism which involves filling chambers in a dosating disk with powder which is then compressed with tamping pins to form plugs, then releasing the plugs into the capsules through an ejection hole in the dosating disk.

There are advantages of the tamping-type method relative to the dosator-type method. The tamping-type method accommodates a greater variety of powder types than the dosator-type method, and results in less powder loss during processing. The tamping-type mechanism is also often simpler, with fewer moving parts and no vacuum or gas required to hold or release the powder doses.

There is thus a need for improved methods and apparatuses for delivering powders into containers. A need exists for a method and apparatus which can be used to accommodate a variety of powder types and deliver the powder into the container in a fast and efficient manner.

Although the present invention may obviate one or more of the above-mentioned disadvantages, it should be understood that some aspects of the invention might not necessarily obviate one or more of those disadvantages.

In the following description, various aspects and embodiments will become evident. In its broadest sense, the invention could be practiced without having one or more features of these aspects and embodiments. Further, these aspects and embodiments are exemplary. Additional objects and advantages of the invention will be set forth in part in the description which follows, and in part will be obvious from the description, or may be learned by practicing of the invention. The objects and advantages of the invention will be realized and attained by means of the elements and combinations particularly pointed out in the appended claims.

SUMMARY OF THE INVENTION

In accordance with exemplary embodiments of the invention, the inventors have devised an apparatus and method for filling containers with material in a manner which is more time and cost efficient than those currently known. Exemplary embodiments of the present invention provide a container-filling apparatus directed to high-speed controlled movement of a succession of containers in a rotating turret which is configured to move the containers through the container-filling apparatus to a dosing portion where they are then are filled with material such as, for example, powder, as well as methods for filling containers with material.

In one exemplary embodiment according to the invention, a dosing portion of the container-filling apparatus comprises a means for holding and dispensing powder, such as a powder hopper, and a tamping mechanism which defines (i) a dosating disk comprising chambers and (ii) tamping pins which may produce a compressed powder in the form of a plug. Once the plug is formed, an ejection pin may then engage the compressed plug and eject it into a container positioned in a rotating turret which is configured to move containers sequentally through the container-filling apparatus beneath or adjacent to the dosating disk. Once the powder has been delivered into the container, the turret may be advanced to the next position for powder delivery into the next sequential container.

A container-conveying means may be used in conjunction with the turret to supply a continual flow of containers for uninterrupted delivery of powder into empty containers and removal of filled containers in each batch. In an exemplary embodiment, the rotating turret may be adjacent to the container-conveying means. In another exemplary embodiment of the invention, the turret may be controlled by a computer and used to hold and/or store containers for powder delivery.

The present invention may be used to fill containers with material such as powder in amounts ranging from about 210 containers to about 3500 containers per hour, with a mass of the material ranging from about 25 mg to about 2 g per container. The material may, in exemplary embodiments, be a powder and comprise at least one drug substance.

In one exemplary embodiment, the present invention provides for an automatic method of filling containers with powder with minimal material loss and minimal starting material. Thus, these efficiencies may require less drug substance, for example, than current systems require.

The term "powder" as used herein includes any solid material made up of grains, granules, particles, or the like. It includes, for example, particulate material such as a pure compound. In the pharmaceutical industry, such a pure compound is often referred to interchangeably as a "drug substance" or "active pharmaceutical ingredient" (API). Powder can also include a blend of drug substance with excipients or other additives, a mixture of different granular or particulate materials (such as API), or both. The granular or particulate materials can include, for example, granulations, agglomerates, pellets, microtablets, and microspheres.

The term "container" as used herein includes any container known by those skilled in the art to be useful for receiving and transporting materials such as powders, including, for example, bottles, vials, or other receptacles, any of which can be made of a variety of materials such as glass, polymers, etc. The term is not, however, intended to include capsules.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF EXEMPLARY EMBODIMENTS

Reference will now be made in greater detail to exemplary embodiments of the invention, examples of which are illustrated in the accompanying drawings. Wherever possible, the same reference numbers will be used throughout the drawings to refer to the same or like parts.

Figure 1:
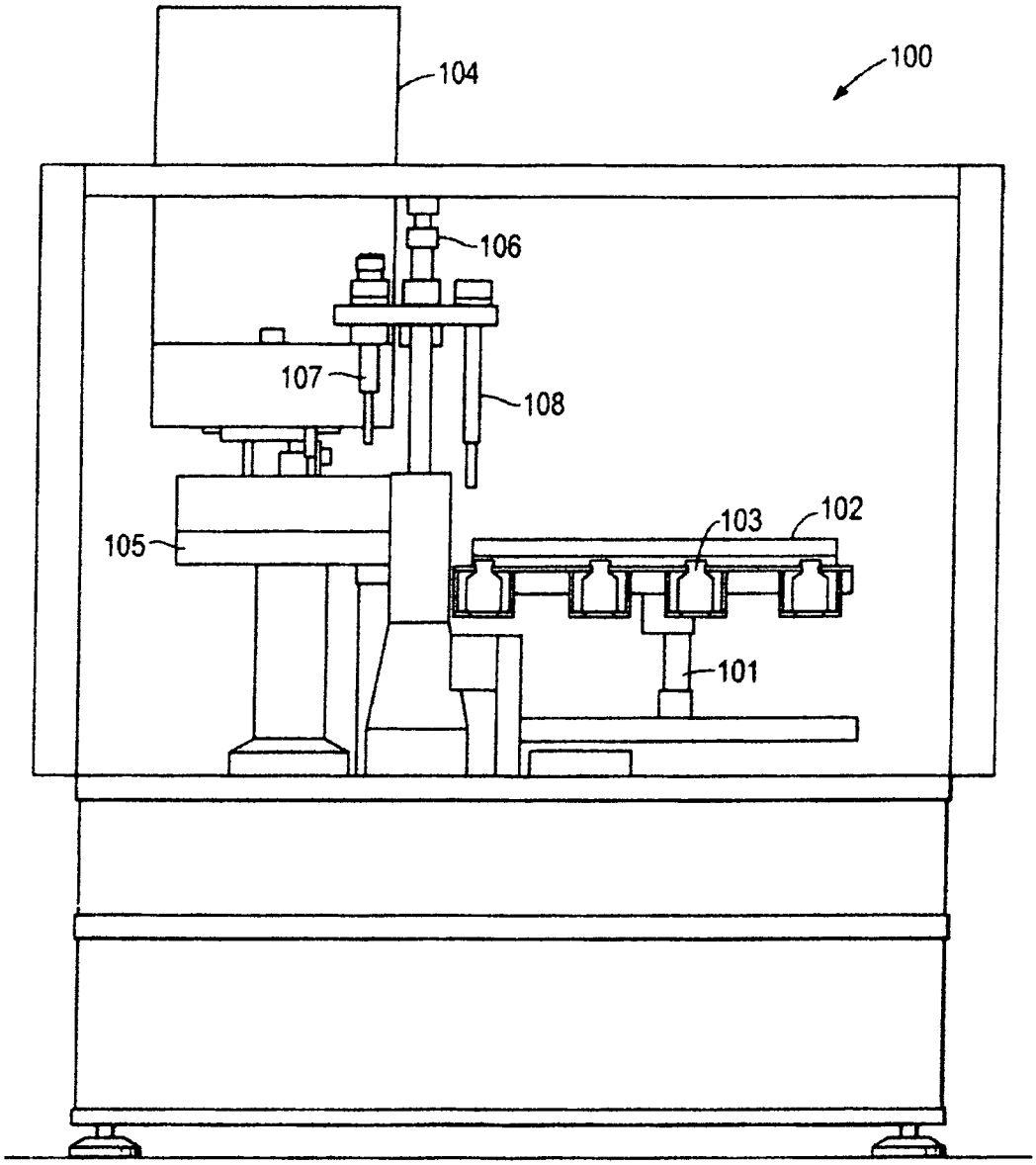
FIG. 1 is a schematic view of a container-filling apparatus according to an exemplary embodiment of the invention.

As can be seen in FIG. 1, a container-filling apparatus 100 according to an exemplary embodiment of the present invention may have a right drive unit 101 onto which a rotating turret 102 that can hold a container 103, for example a bottle, is mounted. A dosing portion of the apparatus may have a means for holding and dispensing material, such as a powder hopper 104, into a dosating disk 105, and a powder dosing and filling group comprising a tamping collar drive piston 106 which may drive a tamping pin 107 and ejection pin 108. The dosating disk 105 may further define one or more chambers (not shown), for example five chambers for compressing the powder into a plug and one for ejecting the plug into the container 103. The powder may be dispensed from the powder hopper 104 into a chamber in the dosating disk 105, after which the tamping pin 107 tamps the powder one or more times to form a compressed slug. This action, i.e. the dispensing of powder and tamping, may be repeated multiple times into each chamber until a plug of desired volume and/or density is formed. The ejection pin 108 (also known in the art as a transfer pin or ejection plunger) may then cause the compressed plug to be ejected into the container 103, at which time the rotating turret 102 may rotate to move the filled container away from the dosing portion and place an empty container into position for receiving the next compressed plug.

Figure 2:
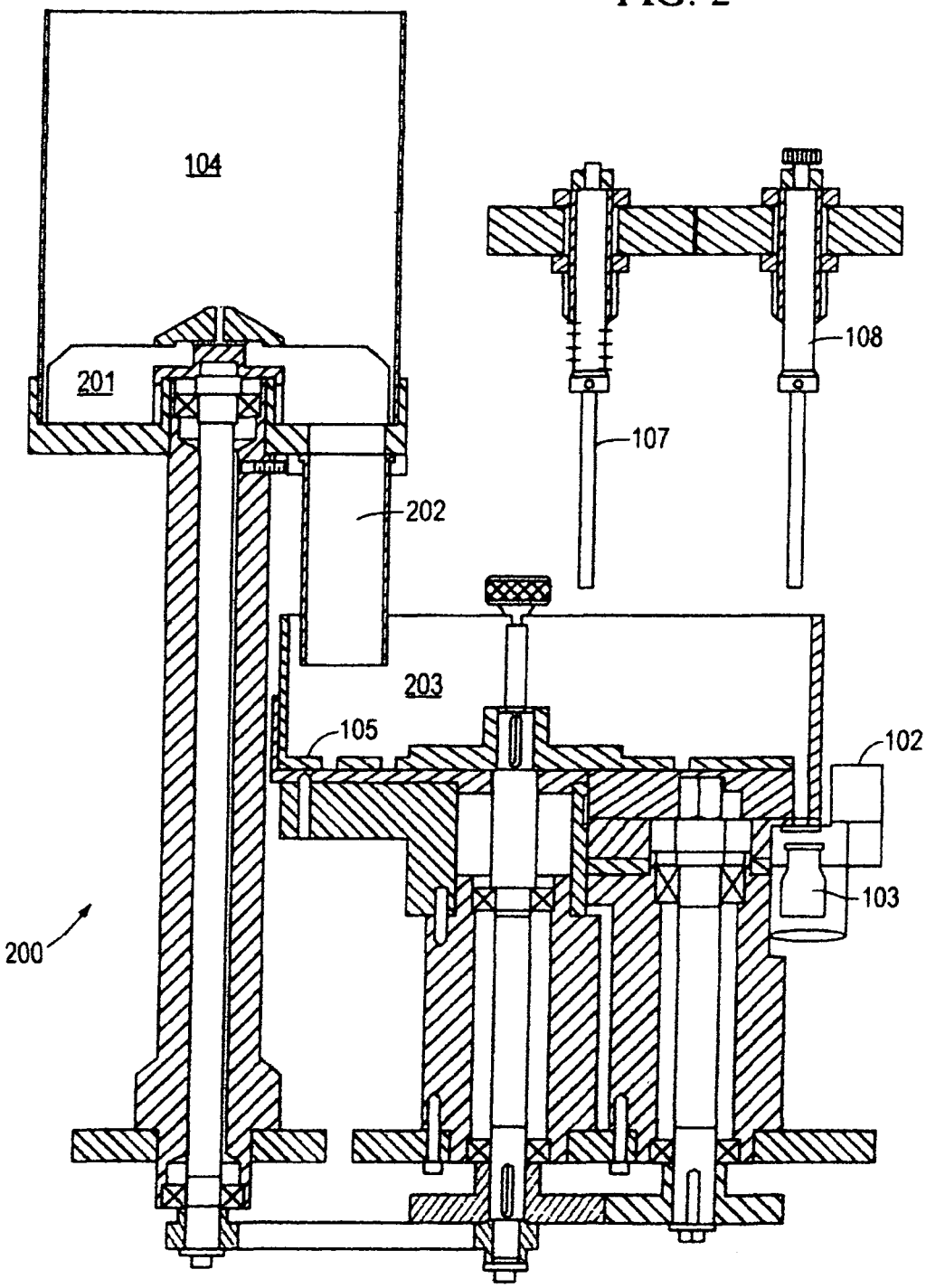
FIG. 2 is a schematic view of a dosing portion of a container-filling apparatus according to an exemplary embodiment of the invention.

FIG. 2 shows an exemplary dosing portion 200 according to another embodiment of the invention. In one exemplary embodiment, the means for holding and dispensing powder 104 may be filled with a powder, for example a powder containing at least one drug substance, and the paddle feeder 201 may move in a way so as to feed the powder in a continuous manner into a powder transfer chute 202, which is connected to a dosating disk 105 comprising a powder bowl 203. The powder may be dispensed into a first chamber in the dosating disk 105, after which the tamping pin 107 tamps the powder one or more times to form a compressed slug. As the dosating disk 105 rotates, additional powder may be dispensed into the first chamber and further tamping may occur. The ejection pin 108 may then cause the compressed plug to be ejected into the container 103, at which time the rotating turret 102 may rotate to move the filled container away from the dosing portion and place an empty container into position for receiving the next compressed plug.

Figure 4:
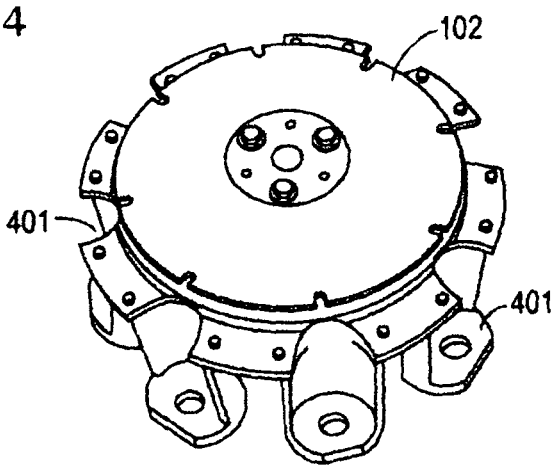
FIG. 4 is a plan view of an exemplary rotating turret for a container-filling apparatus according to an exemplary embodiment of the invention.

As can be seen in FIG. 4, the rotating turret 102 may define one or more cavities 401, such as, for example, eight cavities, into which the containers 103 are situated as the turret 102 rotates and moves the containers through the apparatus 100 to the dosing portion 200. It will be noted, however, that the type, configuration, and number of cavities 401 seen in FIG. 4 is exemplary only, and one skilled in the art may optionally change these parameters as desired. The rotating turret 102 may be configured to advance the containers through the apparatus 100 to the dosing portion 200 in a high-speed, controlled movement in succession.

Figure 5:
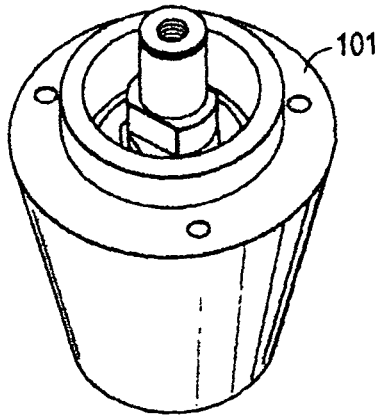
FIG. 5 is a plan view of an exemplary right drive unit of a container-filling apparatus according to an exemplary embodiment of the invention, onto which a rotating turret can be mounted.

The rotating turret 102 may be mounted on the container-filling apparatus 100 by means of, for example, a right drive unit 101 as seen in FIG. 5. There may also be provided a container-conveying means (not shown), such as, for example, a bottle feeder, which may optionally be adjacent to the rotating turret 102 and can move the containers into position to be fed into the rotating turret 102. The container-filling apparatus may, in an exemplary embodiment, function in the following manner which also illustrates an exemplary method of filling containers according the one embodiment of the invention.

In one exemplary embodiment, the dosating disk 105 may rotate underneath the powder hopper 104 and the powder may be progressively tamped at the five stations to form the plug. The tamping pins 107 may move up and down in an intermittent manner at the stations while the dosating disk 105 is indexed in a circular path past the stations to form a plug. Starting at station one, the powder may fill the chamber in the dosating disk 105 and may be tamped or compressed with the tamping pins 107 at that station. The dosating disk 105 may then be rotated to station two, while more powder enters the cavity left by tamping the powder at station one. At station two, the tamping pins 107 may again be lowered into the cavity to again compress the powder. Thereafter, the dosating disk 105 may be rotated through stations three, four, and five, with sequential compression of the powder being effected with the tamping pins 107 at those stations. The container-conveying means can engage the containers 103 and move the containers toward the rotating turret 102 which may then engage the containers 103 in the cavities 401 in succession. The rotating turret 102 can then rotate in a circular motion such that the containers 103 are sequentially moved into the dosing portion 200 and under an ejection hole in the dosating disk 105. An ejection pin 108 then engages the compressed plug in the chamber and ejects it into a container positioned in the turret 102 beneath the ejection chamber of the dosating disk 105. The turret 102 may then rotate to bring the next empty container 103 into position to receive the next compressed plug.

Figure 3:
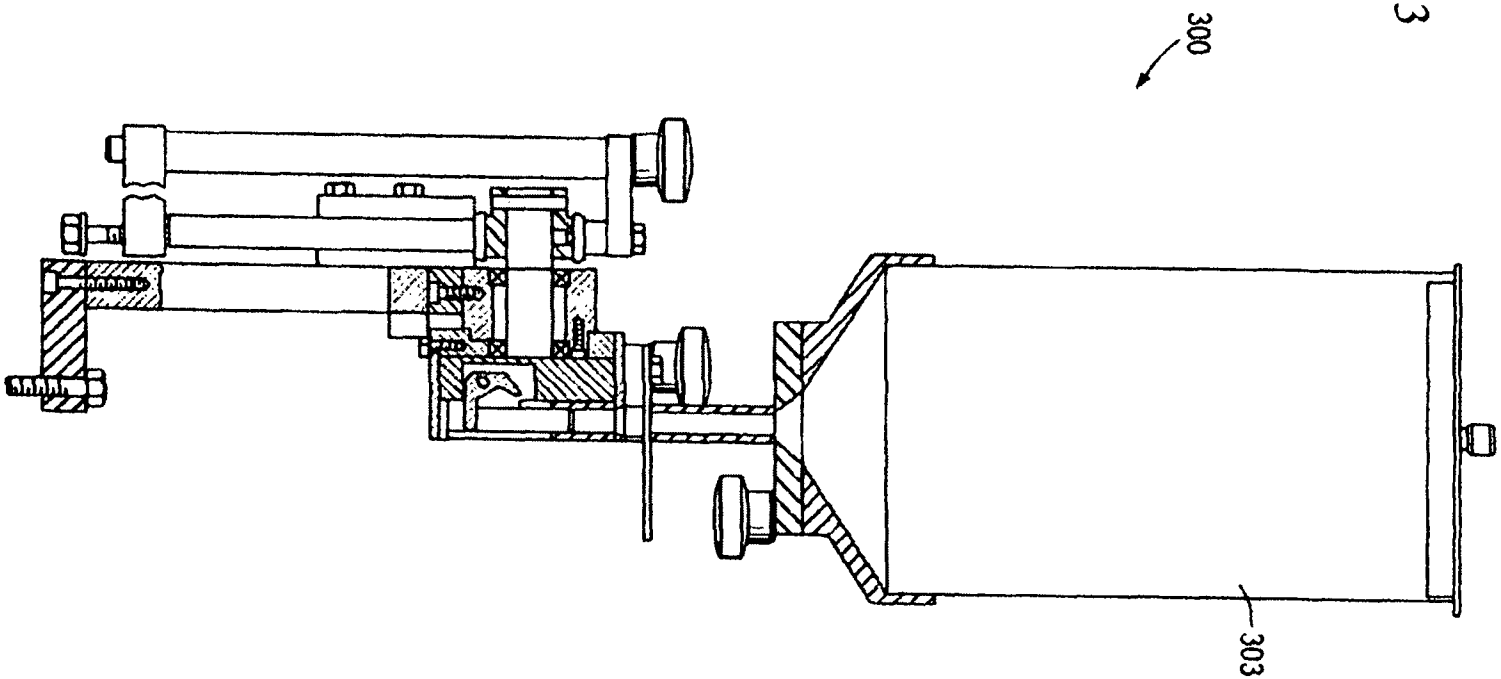
FIG. 3 is a schematic view of an exemplary pellet dosing group of the dosing portion of a container-filling apparatus according to an exemplary embodiment of the invention.

Other means known to those skilled in the art for providing the desired material, such as, for example, a pellet dosing system 300 (FIG. 3) attached to a powder holder and dispenser 303, can also be used in the present invention as a means for dispensing material in one exemplary embodiment of the invention. In addition, other tamping mechanisms known to those skilled in the art can also be used in various embodiments of the present invention. Those skilled in the art will have the knowledge to substitute various parts of the apparatus and steps of the process described without undue experimentation, and without significantly departing from the invention described herein.

The following example, which is not intended to be limiting, shows an exemplary illustration of the above-described apparatus and method.

EXAMPLE

An InCap tamping type capsule filling machine manufactured by Dott Bonapace & C, Milano, Italy was modified by removing the parts of the machine that bring in, separate, and move capsules into position to receive powder, and put capsules together. What remained were the powder hopper, dosating disk, and mechanism for tamping material in the disk and ejecting a plug of compressed powder. A turret was designed and constructed (FIG. 4) that holds eight bottles to be filled. The bottle turret was mounted in a position where rotation would sequentially move the bottles under the ejection hole of the dosating disk at the correct time for delivery of a plug of compressed powder to each bottle.

Bottles were fed to the bottle turret using a rotary moving table holding a supply of bottles. A channel in the table directed bottles into the rotating bottle turret, and after the turret advanced the empty bottles through the apparatus into the location under the ejection hole of the dosating disk, plugs of the powder which had been made by the tamping mechanism were ejected into the bottles. In this example, the filled bottles were removed manually.

COMPARATIVE EXAMPLE

The following comparative example shows how an exemplary embodiment of the present invention can improve both time and cost efficiency of filling containers with powders.

A campaign to fill 5000 bottles each with 2 grams of a placebo substance A was carried out by weighing by hand the material into bottles that were situated on a balance. It required six people working full time four weeks to complete the campaign. Using the exemplary container-filling apparatus according to an embodiment of the invention as shown in Example 1, a similar campaign was completed by six people working full time for two days.

Although the present invention herein has been described with reference to various exemplary embodiments, it is to be understood that these embodiments are merely illustrative of the principles and applications of the present invention. Those having skill in the art would recognize that a variety of modifications to the exemplary embodiments may be made, including modifications to the number and arrangement of various parts, materials, and methodologies, such as, for example, the type and number of containers which can be used in the rotating turret, the type of container-conveying means used, the type of tamping process used, the way the turret is attached to the apparatus, etc., without departing from the scope of the invention.

Moreover, it should be understood that various features and/or characteristics of differing embodiments herein may be combined with one another. It is therefore to be understood that numerous modifications may be made to the illustrative embodiments and that other arrangements may be devised without departing from the scope of the invention.

Furthermore, other embodiments of the invention will be apparent to those skilled in the art from consideration of the specification and practice of the invention disclosed herein. It is intended that the specification and examples be considered as exemplary only, with a scope and spirit being indicated by the following claims.

What is claimed is:

1. An apparatus for filling containers with powder comprising:

a container conveyor;

a rotating turret configured to rotate the containers through the apparatus; and a dosing portion constructed to dispense powder into a dosating disk, wherein the dosing portion includes a tamping pin operative to compress the powder into at least one chamber formed in the dosating disk, wherein the dosing portion includes an ejection pin constructed to engage the compressed powder in the chamber and eject the compressed powder into the container through an ejection hole formed in the dosating disk, wherein the dosating disk includes a sidewall that defines a powder bowl that receives the powder, and wherein the ejection hole is formed in a portion of the dosating disk defined by the sidewall.

2. The apparatus according to claim 1, wherein the containers are bottles.

3. The apparatus according to claim 1, wherein the container conveyor is a bottle feeder.

4. The apparatus according to claim 1, wherein the rotating turret is adjacent to the container conveyor.

5. The apparatus according to claim 1, wherein a powder hopper is provided to dispense powder.

6. The apparatus according to claim 1, wherein the powder comprises at least one drug substance.

7. A method of filling a container with powder comprising the steps of:

placing a container in a container conveyor which advances the container to a rotating turret configured to rotate the container through a container-filling apparatus;

rotating the turret to move the container to a position in a dosing portion of the container-filling apparatus constructed to dispense powder into a dosating disk, the dosing portion including a tamping pin operative to compress the powder into at least one chamber formed in the dosating disk and including an ejection pin constructed to engage the compressed powder in the chamber and eject the compressed powder into the container through an ejection hole formed in the dosating disk, wherein the dosating disk includes a sidewall that defines a powder bowl that receives the powder, and wherein the ejection hole is formed in a portion of the dosating disk defined by the sidewall;

dispensing a dose of powder into the powder bowl of the dosating disk;

tamping the powder with the tamping pin into a compressed plug of powder in the chamber of the dosating disk; and engaging the compressed plug of powder with the ejection pin and ejecting the plug of powder from the dosating disk through the ejection hole in the dosating disk into the container.

8. The method according to claim 7, wherein the containers are bottles.

9. The method according to claim 7, wherein the container conveyor is a bottle feeder.

10. The method according to claim 7, wherein the rotating turret is adjacent to the container conveyor.

11. The method according to claim 7, wherein a powder hopper is provided to dispense powder.

12. The method according to claim 7, wherein the powder comprises at least one drug substance.

13. An apparatus for filling containers with powder comprising:

a rotating turret configured to rotate the containers through the apparatus; and a dosing portion defining a means for dispensing powder into a dosating disk defining at least one chamber, tamping pin, ejection hole, and ejection pin, wherein the dosating disk has a sidewall, wherein the ejection hole is formed in a portion of the dosating disk defined by the sidewall, and wherein said containers are not capsules.

14. The apparatus according to claim 13, wherein the containers are bottles.

15. The apparatus according to claim 13, wherein the means for dispensing powder comprises a powder hopper.

16. The apparatus according to claim 13, wherein the powder comprises at least one drug substance.

17. A method of filling a container with powder comprising the steps of:

placing a container in a rotating turret configured to rotate the container through a container-filling apparatus;

rotating the turret to move the container to a position in a dosing portion of the container-filling apparatus constructed to dispense powder into a dosating disk,. the dosing portion including a tamping pin operative to compress the powder into at least one chamber formed in the dosating disk and including an ejection pin constructed to be inserted into an ejection hole formed in the dosating disk to eject the compressed powder from the ejection hole into the containers, wherein the dosating disk includes a sidewall that defines a powder bowl that receives the powder, and wherein the ejection hole is formed in a portion of the dosating disk defined by the sidewall;

dispensing a dose of powder into the powder bowl of the dosating disk;

tamping the powder with the tamping pin into a compressed plug of powder in the chamber of the dosating disk; and engaging the compressed plug of powder with the ejection pin and ejecting the plug of powder from the dosating disk through the ejection hole in the dosating disk into the container.

18. The method according to claim 17, wherein the containers are bottles.

19. The method according to claim 17, wherein a powder hopper is provided to dispense powder.

20. The method according to claim 17, wherein the powder comprises at least one drug substance.

* * * * *